United States Patent [19]

Bresson et al.

[11] Patent Number: 4,518,492

[45] Date of Patent: May 21, 1985

[54] ORE FLOTATION WITH COMBINED COLLECTORS

[75] Inventors: Clarence R. Bresson; Kenneth B. Kimble, both of Bartlesville, Okla.

[73] Assignee: Phillips Petroleum Company, Bartlesville, Okla.

[21] Appl. No.: 621,337

[22] Filed: Jun. 15, 1984

[51] Int. Cl.[3] ..... B03D 1/14

[52] U.S. Cl. ..... 209/166; 252/61; 260/455 B

[58] Field of Search ..... 260/455 B; 209/166, 209/167; 252/61

[56] References Cited

U.S. PATENT DOCUMENTS

| | | | |
|---|---|---|---|
| 1,659,396 | 2/1928 | Douglas | 260/455 B |
| 2,501,269 | 3/1950 | Fischer | 209/166 |
| 4,211,644 | 7/1980 | Wiechers | 209/166 |
| 4,341,715 | 7/1982 | Parlman et al. | 209/166 |
| 4,439,314 | 3/1984 | Parlman et al. | 209/166 |
| 4,462,898 | 7/1984 | Parlman et al. | 209/166 |

*Primary Examiner*—Bernard Nozick

*Attorney, Agent, or Firm*—French and Doescher

[57] ABSTRACT

S-carbalkoxy-S'-alkyl trithiocarbonate and n-dodecyl mercaptan are used for flotation of copper, nickel and iron-containing ores. S-carbalkoxy-S'-alkyl trithiocarbonate, n-dodecyl mercaptan and poly(propylene glycol) are used for the flotation of copper, nickel and iron-containing ores. Other ores are disclosed as being suitable for the flotation thereof with these novel compositions.

28 Claims, No Drawings

ORE FLOTATION WITH COMBINED COLLECTORS

The present invention relates generally to mineral recovery by flotation operations. In one aspect the invention relates to a new composition comprising two flotation ingredients. In another aspect the invention relates to ore flotation processes, such as, for example, those processes involving recovery of copper, nickel, molybdenum, zinc and iron.

Flotation processes are used for recovering and concentrating minerals from ores. In froth flotation processes, the ore is crushed and wet ground to obtain a pulp. Additives, such as mineral flotation or collecting agents, frothers, depressants, stabilizers, etc., are added to the pulp to assist the separation of valuable materials from the undesired minerals or gangue portions of the ore in one or more subsequent flotation steps. The pulp is then aerated to produce a froth at the surface. The minerals which adhere to the bubbles or froth are skimmed or otherwise removed and the mineral-bearing froth is collected and further processed to recover the desired minerals. Other valuable minerals can be recovered from the tail product which is separated from the mineral-bearing froth during the flotation process. Typical mineral flotation collectors include xanthates, amines, alkyl sulfates, arenes, sulfonates, dithiocarbamates, dithiophosphates, trithiocarbonates and thiols.

U.S. Pat. No. 2,600,737 describes alkali metal salts of tertiary alkyl trithiocarbonates and processes for making such salts. This patent also describes the use of such compounds in ore flotation. Sodium diethyl dithiophosphate has also been described in other references as a collector in the separation of zinc and copper. The prior art has also described potassium ethyl xanthate and potassium isoamyl xanthate as ore flotation collectors for copper.

U.S. Pat. No. 4,341,715 discloses the synthesis of S-allyl-S'-n-butyl trithiocarbonate, and further discloses the use of such compound as a mineral sulfide collector in ore flotation. This patent does not mention the use of such compound with other collectors in an ore flotation process.

U.S. Pat. No. 4,316,797 discloses the use of trithocarbonates, such as, for example, S-allyl-S'-n-butyl trithiocarbonate, which are blended on a 1:1 weight ratio with $SO_2$ extract oil to produce a product which is useful as a mineral sulfide collector. This patent does not mention the employment of such a product blend with other collectors in an ore flotation process.

While the art of ore flotation has reached a significant degree of sophistication, it is a continuing goal in the ore recovery industry to increase the productivity of ore flotation processes and, above all, to provide specific processes which are selective to one ore or to one metal over other ores or other metals, respectively, which are present in the materials being treated in such processes.

It is thus one object of this invention to provide a new composition which is useful in ore flotation.

Another object of this invention is to provide an ore flotation process.

A further object of this invention is to provide an improved flotation process using new compositions to improve the recovery of copper and nickel.

These and other objects, advantages, details, features and embodiments of this invention will become apparent to those skilled in the art from the following detailed description of the invention and the appended claims.

In accordance with this invention it has been found that the recovery of copper and nickel is synergistically improved when S-carbalkoxy-S'-alkyl trithiocarbonate and n-dodecyl mercaptan are used together in a flotation process.

Thus, in accordance with a first embodiment of this invention, novel ore flotation compositions are provided. These novel ore flotation compositions include a mixture of substantial quantities of S-carbalkoxy-S'-alkyl trithiocarbonate and n-dodecyl mercaptan. In an alternate embodiment of this invention, the novel ore flotation compositions include a mixture of substantial quantities of S-carbalkoxy-S'-alkyl trithiocarbonate, n-dodecyl mercaptan, and poly(propylene glycol).

A suitable S-carbalkoxy-S'-alkyl trithiocarbonate for use in the present invention is designated S-carbethoxy-S'-ethyl trithiocarbonate. S-carbalkoxy-S'-alkyl trithiocarbonate can be generally characterized by the following structural formula

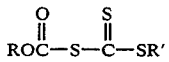

wherein R and R' are each selected from the group consisting of alkyl, alkenyl and aryl radicals, and wherein R and R' can be the same or different. The composition S-carbethoxy-S'-ethyl trithiocarbonate can be characterized by the following formula

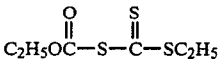

The two synergistically combined components of the novel ore flotation compositions of the present invention are generally present in the composition in weight ratios in the range from about 30:70 to about 70:30, preferably in the range from about 40:60 to about 60:40, and more preferably in the range from about 45:55 to about 55:45. The two synergistically acting components of the flotation agents of the present invention provide outstanding results when they are present in roughly the same quantity by weight.

In the inventive ore flotation composition comprising a blend of n-dodecyl mercaptan and poly(propylene glycol), it is presently preferred that these compounds are respectively present in the blend in a weight ratio generally in the range from about 6:1 to about 3:1, and it is presently preferred that the weight ratio of this blend of n-dodecyl mercaptan and poly(propylene glycol) is roughly about 3:1.

It is presently preferred that the poly(propylene glycol) employed in the inventive blend be employed in the form of poly(propylene glycol) monomethyl ether. Suitable poly(propylene glycol) monomethyl ethers are commercially available under the trademarks Dowfroth 250, Flotanol C7, etc.

The production of a presently preferred S-carbalkoxy-S'-alkyl trithiocarbonate for use in the inventive blends of the present invention is set forth in the following example.

EXAMPLE I

This example describes the preparation of an alkyl formate ester of trithiocarbonic acid, namely, S-carbethoxy-S'-ethyl trithiocarbonate. 1000 Milliliters of water and 21 grams (0.53 mole) of sodium hydroxide are added to a 3-necked glass flask fitted with a stirrer, dropping funnel, thermometer and condenser. After the hydroxide is dissilved, 31.3 grams (0.5 mole) of ethyl mercaptan is slowly added to the flask. When the reaction temperature was below 45° C., 38.1 grams (0.5 mole) of carbon disulfide is slowly added to the flask with stirring. After all of the carbon disulfide has been added, the mixture is stirred for about 1 hour during which time the temperature decreases to about 25° C. Ethyl chloroformate, 54.3 grams (0.5 mole), is slowly added dropwise to the flask during which time the temperature rises to about 55° C. and a second bright red phase separates. When all the ethyl chloroformate is in solution, the mixture is stirred for 2 more hours. The red (top) organic phase is separated from the nearly colorless aqueous phase. There is obtained 91.5 grams of the red organic layer which is assumed to be essentially all S-carbethoxy-S'-ethyl trithiocarbonate.

In accordance with another embodiment of this invention, a flotation process is provided. This flotation process involves the steps of mixing mineral material, water, and one of the inventive compositions described above to establish a pulp. This step is followed by aerating the thus established pulp to produce a froth and a tail product, separating the froth and the tail product and recovering mineral values from the froth. Mineral values can also be recovered from the tail product.

The process steps described above are conventional except for the use of a composition in accordance with the present invention as a collector as described. Although the individual compounds of the inventive composition described above can be added separately during the froth flotation operation, it is preferred that the composition comprising S-carbalkoxy-S'-alkyl trithiocarbonate and n-dodecyl mercaptan be premixed, blended or otherwise combined before using compositions in accordance with the present invention in an ore flotation process. While any amount of inventive collector blend can be employed in an ore flotation process which will achieve the desired results, such collector blend is generally employed in the range from about 0.001 to about 1 lb/ton of ore or mineral material, and is more preferably employed in the range from about 0.01 to about 0.3 lb/ton of ore or mineral material.

It is generally believed that the inventive compositions disclosed herein are useful for separating any valuable metal from its corresponding gangue material. It is also understood that the inventive compositions can separate a mixture of metals that are contained in a particular mining deposit or ore, such mixture being further separated by subsequent froth flotations or any other conventional separating methods. Similarly, it will be understood that the inventive compositions can separate a mixture of metals that are contained in a concentrate such as a rougher concentrate in which a mining deposit or ore has been previously subjected to separation procedures such as ore flotation. The inventive compositions herein disclosed are particularly useful for separating copper, nickel and iron from the total ore. Ores with which the compositions of the present invention can be employed in ore flotation processes include, but are not limited to such materials as:

| | |
|---|---|
| Molybdenum-Bearing ores: | |
| Molybdenite | $MoS_2$ |
| Wulfenite | $PbMoO_4$ |
| Powellite | $Ca(Mo,W)O_4$ |
| Ferrimolybdite | $Fe_2Mo_3O_{12}.8H_2O$ |
| Copper-bearing ores: | |
| Covellite | $CuS$ |
| Chalcocite | $Cu_2S$ |
| Chalcopyrite | $CuFeS_2$ |
| Bornite | $Cu_5FeS_4$ |
| Cubanite | $Cu_2SFe_4S_5$ |
| Valerite | $Cu_2Fe_4S_7$ or $Cu_3Fe_4S_7$ |
| Enargite | $Cu_3(As,Sb)S_4$ |
| Tetrahedrite | $Cu_{12}Sb_4S_{13}$ |
| Tennanite | $Cu_{12}As_4S_{13}$ |
| Cuprite | $Cu_2O$ |
| Tenorite | $CuO$ |
| Malachite | $Cu_2(OH)_2CO_3$ |
| Azurite | $Cu_3(OH)_2CO_3$ |
| Antlerite | $Cu_3SO_4(OH)_4$ |
| Brochantite | $Cu_4(OH)_6SO_4$ |
| Atacamite | $Cu_2Cl(OH)_3$ |
| Chrysocolla | $CuSiO_8$ |
| Famatinite | $Cu_3(Sb,As)S_4$ |
| Bournonite | $PbCuSbS_3$ |
| Lead-Bearing ore: | |
| Galena | $PbS$ |
| Antimony-Bearing ore: | |
| Stibnite | $Sb_2S_3$ |
| Zinc-Bearing ores: | |
| Sphalerite | $ZnS$ |
| Zincite | $ZnO$ |
| Smithsonite | $ZnCO_3$ |
| Silver-Bearing ores: | |
| Argentite | $Ag_2S$ |
| Stephanite | $Ag_5SbS_4$ |
| Hessite | $Ag_2Te$ |
| Chromium-Bearing ores: | |
| Daubreelite | $FeSCrS_3$ |
| Chromite | $FeO.Cr_2O_3$ |
| Iron-Bearing ores: | |
| Pyrite | $FeS_2$ |
| Marcasite | $FeS_2$ |
| Pyrrhotite | $Fe_7S_8$ |
| Nickel-Bearing ores: | |
| Pentlandite | $(FeNi)S$ |
| Millerite | $NiS$ |
| Niccolite | $NiAs$ |
| Gold-Bearing ores: | |
| Sylvanite | $(AuAg)Te_2$ |
| Calaverite | $AuTe_2$ |
| Platinum-Bearing ores: | |
| Cooperite | $Pt(AsS)_2$ |
| Sperrylite | $PtAs_2$ |
| Uranium-Bearing ores: | |
| Pitchblende | $U_2O_5(U_3O_8)$ |
| Gummite | $UO_3.nH_2O$. |

The presently preferred ores in connection with which the process of this invention is applied are copper, nickel and iron ores or minerals.

Any froth flotation apparatus can be used in this invention. The most commonly used commercial flotation machines are the Agitar (Galigher Co.), Denver Sub-A (Denver Equipment Co.), and the Fagergren (Western Machinery Co.). Smaller Laboratory scale apparatus such as the Hallimond cell can also be used.

The instant invention was demonstrated in tests conducted at ambient room temperature to about 37° C. (100° F.) and atmospheric pressure. However, any temperature or pressure generally employed by those skilled in the art is within the scope of this invention.

The following example serves to illustrate this invention without undue limitation of the scope thereof.

EXAMPLE II

This example describes a mineral ore flotation process whereby the collectors described herein were evaluated. To a ball mill was added 750 grams of a Cu/-Ni/Fe-containing ore (Falconbridge) along with 300 milliliters of tap water and 0.9 gram (2.4 lbs/ton) lime and the mixture ground for 2 minutes and 55 seconds. The ground mixture was transferred to a 2.5 Liter capacity Denver D-12 flotation cell along with enough water to make about a 30 weight percent slurry. Also added to the cell was 3 drops (0.034 lb/ton) of a frother (Dowfroth 250) and 0.3 milliliter (0.008 lb/ton) of a 1 weight percent aqueous solution of sodium isopropyl xanthate (from American Hoechst) and the slurry conditioned at 1100 rpm for 1 minute. After conditioning, the slurry was floated for 7 minutes and the concentrate filtered, dried and analyzed. The procedure was repeated and an average weight percent recovery estimated. In this manner there was obtained average weight recoveries of 49.4 percent Cu, 14.7 percent Ni, and 8.3 percent Fe (Run 1). The amount of xanthate collector used was intentionally low so that it could be determined whether any additional reagent added to the system containing the xanthate would act as a collector, depressant or have no effect.

Thus, the flotation procedure was repeated except, in addition to the xanthate collector, there was added 0.15 lb/ton of the reagent prepared in accordance with Example I, namely, S-carbethoxy-S'-ethyl trithiocarbonate. From this flotation there was obtained average weight recoveries of 78.2 weight percent Cu, 38.9 weight percent Ni, 15.2 weight percent Fe (Run 2).

The flotation procedure was again repeated except, in addition to the xanthate collector, there was added 0.15 lb/ton of a mercaptan/glycol blend, namely, 75 weight percent n-dodecyl mercaptan/25 weight percent poly(-propylene glycol) monomethyl ether (Flotanol C7). From this flotation there was obtained average weight recoveries of 79.0 weight percent Cu, 45.9 weight percent Ni, 26.3 weight percent Fe (Run 3).

The flotation procedure was once again repeated except, in addition to the xanthate collector, there was added 0.15 lb/ton of a 50:50 weight ratio blend of the trithiocarbonate and mercaptan/glycol collectors described. The results along with those previously described are listed in Table I and indicate that the blend of trithiocarbonate and mercaptan/glycol collectors improves the recoveries of Cu, Ni, Fe (run 4). In addition to the improved recoveries, there is an economic advantage of the blend, especially for the trithiocarbonate which by itself is more expensive than the mercaptan/glycol collector.

TABLE I

Carbalkoxy Alkyl Trithiocarbonate/Mercaptan Blends as Mineral Collectors

| | Collectors, lb/ton | | | Av. Wt. % Recovery | | |
|---|---|---|---|---|---|---|
| Run: | NaIPX[a] | Carbonate[b] | Mercaptan[c] | Cu | Ni | Fe |
| Control: | | | | | | |
| 1 | 0.008 | — | — | 49.4 | 14.7 | 8.3 |
| 2 | 0.008 | 0.15 | — | 78.2 | 38.9 | 15.2 |
| 3 | 0.008 | — | 0.15 | 79.0 | 45.9 | 26.3 |
| Invention: | | | | | | |

TABLE I-continued

Carbalkoxy Alkyl Trithiocarbonate/Mercaptan Blends as Mineral Collectors

| | Collectors, lb/ton | | | Av. Wt. % Recovery | | |
|---|---|---|---|---|---|---|
| Run: | NaIPX[a] | Carbonate[b] | Mercaptan[c] | Cu | Ni | Fe |
| 4 | 0.008 | 0.075 | 0.075 | 79.2 | 48.5 | 28.3 |

[a]1 Wt. % aqueous sodium isopropyl xanthate
[b]40 Wt. % aqueous S—carbethoxy-S'—ethyl trithiocarbonate
[c]75 Wt. % n-dodecyl mercaptan/25 wt. % poly(propylene glycol) monomethyl ether (Flotanol C7) frother Reasonable variations and modifications which will become apparent to those skilled in the art can be made in this invention without departing from the spirit and scope thereof.

We claim:

1. A composition comprising a mixture which contains both of the following compounds in substantial quantities (a) S-carbalkoxy-S'-alkyl trithiocarbonate; and (b) n-dodecyl mercaptan.

2. A composition in accordance with claim 1 characterized further to include a quantity of water.

3. A composition in accordance with claim 1 characterized further to contain a substantial quantity of the compound (c) poly(propylene glycol).

4. A composition in accordance with claim 3 wherein the weight ratio of the weight of compound (a) to the total weight of compounds (b) and (c) is in the range from about 40:60 to about 60:40.

5. A composition in accordance with claim 3 wherein the weight ratio of the weight of compound (a) to the total weight of compounds (b) and (c) is in the range from about 45:55 to about 55:45.

6. A composition in accordance with claim 3 characterized further to include a quantity of water.

7. An ore flotation process comprising:

mixing mineral material, water, and a composition as defined in claim 3 to establish a pulp;

aerating said thus established pulp to produce a froth and a tail product;

separating said froth and said tail product; and recovering mineral values from said froth.

8. An ore flotation process in accordance with claim 7 characterized further to include:

recovering mineral values from said tail product.

9. An ore flotation process in accordance with claim 7 wherein said composition comprising said compounds (a), (b) and (c) is employed in a quantity in the range from about 0.001 to about 1 lb/ton of mineral material.

10. A composition in accordance with claim 3 wherein the weight ratio of compound (a) to the total weight of compounds (b) and (c) is in the range from about 30:70 to about 70:30.

11. An ore flotation process comprising:

mixing mineral material, water, and a composition as defined in claim 10 to establish a pulp;

aerating said thus established pulp to produce a froth and a tail product;

separating said froth and said tail product; and recovering mineral values from said froth.

12. An ore flotation process in accordance with claim 11 wherein said composition comprising said compounds (a), (b) and (c) is employed in a quantity in the range from about 0.001 to about 1 lb/ton of mineral material.

13. A composition in accordance with claim 10 wherein the weight ratio of the weight of compound (b) to the weight of compound (c) is in the range from about 6:1 to about 3:1.

14. An ore flotation process comprising:

mixing mineral material, water, and a composition as defined in claim 13 to establish a pulp;

aerating said thus established pulp to produce a froth and a tail product;

separating said froth and said tail product; and recovering mineral values from said froth.

15. An ore flotation process in accordance with claim 14 wherein said composition comprising said compounds (a), (b) and (c) is employed in a quantity in the range from about 0.001 to about 1 lb/ton of mineral material.

16. An ore flotation process in accordance with claim 14 wherein said composition comprising said compounds (a), (b) and (c) is employed in a quantity in the range from about 0.01 to about 0.3 lb/ton of mineral material.

17. An ore flotation process comprising:

mixing mineral material, water, and a composition as defined in claim 1 to establish a pulp;

aerating said thus established pulp to produce a froth and a tail product;

separating said froth and said tail product; and recovering mineral values from said froth.

18. An ore flotation process in accordance with claim 17 characterized further to include:

recovering mineral values from said tail product.

19. An ore flotation process in accordance with claim 17 wherein said mineral material comprises crushed ore.

20. An ore flotation process in accordance with claim 17 wherein the composition comprising compounds (a) and (b) is employed in the range from about 0.001 to about 1 lb/ton of mineral material.

21. An ore flotation process in accordance with claim 17 wherein said mineral material comprises copper, nickel and iron.

22. A composition comprising a mixture which contains both the following compounds in substantial quantities (a) a compound having the formula $$ROC(=O)-S-C(=S)-SR'$$

wherein R and R′ are each selected from the group consisting of alkyl, alkenyl and aryl radicals; and (b) n-dodecyl mercaptan.

23. A composition in accordance with claim 22 characterized further to contain a substantial quantity of the compound (c) poly(propylene glycol).

24. A composition in accordance with claim 23 wherein the weight ratio of the weight of compound (a) to the total weight of compounds (b) and (c) is in the range from about 30:70 to about 70:30.

25. A composition in accordance with claim 24 wherein the weight ratio of the weight of compound (b) to the weight of compound (c) is in the range from about 6:1 to about 3:1.

26. An ore flotation process comprising:

mixing mineral material, water, and a composition as defined in claim 22 to establish a pulp;

aerating said thus established pulp to produce a froth and a tail product;

separating said froth and said tail product; and recovering mineral values from said froth.

27. An ore flotation process in accordance with claim 26 characterized further to include:

recovering mineral values from said tail product.

28. An ore flotation process in accordance with claim 26 wherein the composition comprising said compounds (a) and (b) is employed in the range from about 0.001 to about 1 lb/ton of mineral material.

* * * * *